US007661447B2

(12) United States Patent
Bailey et al.

(10) Patent No.: US 7,661,447 B2
(45) **Date of Patent: *Feb. 16, 2010**

(54) METHOD AND APPARATUS FOR LOADING A CONTAINER WITH A PRODUCT

(75) Inventors: Thomas William Bailey, Coventry (GB); Jeremy Keith Baker, Coventry (GB); Roger Don Self, Ware (GB); Raymond Herbert Scherzer, Durham, NC (US)

(73) Assignee: Glaxo Group Limited, Greenford, Middlesex (GB)

( * ) Notice: Subject to any disclaimer, the term of this patent is extended or adjusted under 35 U.S.C. 154(b) by 307 days.

This patent is subject to a terminal disclaimer.

(21) Appl. No.: 10/509,465

(22) PCT Filed: Apr. 3, 2003

(86) PCT No.: PCT/GB03/01447

§ 371 (c)(1),
(2), (4) Date: Sep. 28, 2004

(87) PCT Pub. No.: WO03/086863

PCT Pub. Date: Oct. 23, 2003

(65) Prior Publication Data

US 2005/0183395 A1 Aug. 25, 2005

(30) Foreign Application Priority Data

Apr. 4, 2002 (GB) ..... 0207769.1

(51) Int. Cl.
*B65B 1/20* (2006.01)
*B65B 1/04* (2006.01)

(52) U.S. Cl. ..... 141/12; 141/73; 141/125; 141/129; 141/144; 53/467

(58) Field of Classification Search ..... 141/2, 141/11, 12, 69, 71, 73, 125, 129, 144–146; 53/467, 471

See application file for complete search history.

(56) References Cited

U.S. PATENT DOCUMENTS 2,365,920 A 12/1944 Vaughn
3,315,713 A * 4/1967 Kincaid ..... 141/1

(Continued)

FOREIGN PATENT DOCUMENTS

DE 2346070 3/1975

(Continued)

OTHER PUBLICATIONS

U.S. Appl. No. 09/979,569, filed Nov. 19, 2001.

(Continued)

*Primary Examiner*—Timothy L Maust
(74) *Attorney, Agent, or Firm*—James P. Riek

(57) ABSTRACT

There is provided a method of loading a container with a defined quantity of product comprising closing off a perforation in a perforated plate; directing powder into the closed-off perforation by the sweeping action of a first director blade spaced from said perforated plate; and transferring the contents of the perforation to said container. The method is characterized by relative rotary motion of the perforated plate and said first director blade. Suitable apparatus is also provided.

32 Claims, 6 Drawing Sheets

U.S. PATENT DOCUMENTS

| | | | | |
|---|---|---|---|---|
| 3,554,412 | A | 1/1971 | Hayashi | |
| 3,565,132 | A | 2/1971 | Lefort | |
| 3,656,518 | A | 4/1972 | Aronson | |
| 3,718,164 | A | 2/1973 | Stewart | |
| 4,182,383 | A | 1/1980 | Adomitis et al. | |
| 4,314,653 | A | 2/1982 | Sindoni | |
| 4,469,144 | A | 9/1984 | Burns | |
| 4,481,987 | A | 11/1984 | Burns | |
| 4,542,835 | A | 9/1985 | Gamberini | |
| 4,607,479 | A | 8/1986 | Linden | |
| 4,628,971 | A | 12/1986 | Belot | |
| 4,688,610 | A | 8/1987 | Campbell | |
| 4,731,979 | A | 3/1988 | Yamamoto et al. | |
| 4,850,259 | A | 7/1989 | Morris | |
| 5,082,032 | A | 1/1992 | Crocker | |
| 5,111,642 | A | 5/1992 | Chiari | |
| 5,143,126 | A | 9/1992 | Boesch et al. | |
| 5,145,009 | A | 9/1992 | Mheidle et al. | |
| 5,192,548 | A | 3/1993 | Velasquez et al. | |
| 5,240,049 | A | 8/1993 | Chiari | |
| 5,287,897 | A | 2/1994 | Gamberini | |
| 5,320,146 | A * | 6/1994 | Stevie | 141/1 |
| 5,549,144 | A | 8/1996 | Dworak et al. | |
| 5,662,849 | A | 9/1997 | Bogue et al. | |
| 5,855,233 | A * | 1/1999 | Bolelli | 141/144 |
| 5,934,343 | A | 8/1999 | Gaylo et al. | |
| 5,950,868 | A | 9/1999 | Wegman | |
| 6,035,905 | A | 3/2000 | Griffin | |
| 6,098,675 | A | 8/2000 | Runft | |
| 7,426,815 | B1 | 9/2008 | Wilson et al. | |
| 2005/0118260 | A1 * | 6/2005 | Bailey et al. | 424/464 |

FOREIGN PATENT DOCUMENTS

| | | | |
|---|---|---|---|
| DE | 3607187 | | 9/1987 |
| DE | 3618041 | | 12/1987 |
| DE | 19533233 | | 3/1997 |
| DE | 19651237 | | 6/1998 |
| EP | 0282958 | | 9/1988 |
| EP | 0768122 | | 4/1997 |
| EP | 0823324 | | 2/1998 |
| EP | 0903290 | | 3/1999 |
| EP | 0903290 | A | 6/2000 |
| FR | 2419235 | | 10/1979 |
| GB | 353594 | | 7/1931 |
| GB | 2167387 | | 5/1986 |
| JP | 54-1280 | A | 1/1979 |
| JP | 62-146102 | A | 6/1987 |
| JP | 3-36393 | U | 4/1991 |
| JP | 53-24387 | U | 1/2000 |
| NL | 8801521 | | 1/1990 |
| SU | 690314 | | 10/1979 |
| SU | 1027081 | | 7/1983 |
| SU | 1062149 | | 12/1983 |
| SU | 1105761 | | 7/1984 |
| SU | 1285440 | | 1/1987 |
| SU | 1357718 | | 12/1987 |
| SU | 1488143 | | 6/1989 |
| WO | 9521768 | | 8/1995 |
| WO | 9531239 | | 11/1995 |
| WO | 96/17776 | | 6/1996 |
| WO | 9635565 | A1 | 11/1996 |
| WO | 9711884 | | 4/1997 |
| WO | 9718991 | | 5/1997 |
| WO | 9741031 | | 11/1997 |
| WO | 9741821 | | 11/1997 |
| WO | 0032474 | | 3/1999 |
| WO | 9919215 | | 4/1999 |
| WO | 0007881 | | 2/2000 |
| WO | WO 00/32474 | | 6/2000 |
| WO | 0071419 | | 11/2000 |
| WO | 0071424 | A | 11/2000 |
| WO | WO 00/71419 | | 11/2000 |
| WO | WO 00/71424 | | 11/2000 |

OTHER PUBLICATIONS

U.S. Appl. No. 10/509,466, filed Sep. 28, 2004.
U.S. Appl. No. 09/979,569, Non-final Office Action dated Dec. 14, 2007.
U.S. Appl. No. 09/979,569 Response to Dec. 14, 2007 Non-final Action.
U.S. Appl. No. 09/979,569 Response to Apr. 10, 2007 Final Action.
U.S. Appl. No. 09/979,569, Applicants' Response to Non-Final Office Action dated Dec. 14, 2007.
U.S. Appl. No. 09/979,569, Notice of Allowance dated Jul. 16, 2008.
U.S. Appl. No. 10/509,466, Non-Final Office Action dated Feb. 3, 2009.
U.S. Appl. No. 10/509,466, Preliminary Amendment dated Sep. 28, 2004.

* cited by examiner

METHOD AND APPARATUS FOR LOADING A CONTAINER WITH A PRODUCT

CROSS-REFERENCE TO RELATED APPLICATIONS

This application is filed pursuant to 35 USC 371 as a U.S. National Phase Application of International Patent Application Ser. No. PCT/GB03/01447 filed on 3 Apr. 2003, which claims priority from GB 0207769.1 filed on 4 Apr. 2002 in the United Kingdom.

FIELD OF INVENTION

This invention relates to a method and apparatus for loading a container with a defined quantity of product. This invention has particular application to loading a blister in a blister pack with a defined quantity of medicament in powder form.

BACKGROUND TO THE INVENTION

The use of blister packs to hold medicaments for inhalation devices, for example in bronchodilation therapy, is well known. The blister packs usually consist of a base sheet in which blisters are formed. The blisters are arranged on the base sheet and can be filled with medicament to be administered through use of an inhalation device. A lid sheet is applied to cover the filled blisters and the two sheets are sealed together to form a blister pack.

There can, however, be problems associated with methods of filling the blisters with medicament. Powder, particularly the drug component of the powder, can tend to be attracted to the base sheet surface rather than to the blister pockets. This attraction of the drug to the base sheet can result in inaccurate filling of the blisters, create mess and potentially cause problems with adherence of the lid sheet to the base sheet. Such filling methods may also require a large reservoir of powder, potentially resulting in waste of the medicament.

In earlier PCT Patent Application No. WO 00/71419, the Applicant described that the potential problem of powder adherence can be overcome by using a filling method utilising a perforated plate to mask the base sheet surface during filling to avoid covering this area with powder and a director (e.g. a director blade) to direct the powder into the perforations of the plate. The perforated plate is moved into contact with the appropriate areas of the blister strip during filling and then moved away at the end of the method and can be reused in each cycle. This filling method can also be used to fill other types of containers e.g. injection moulded plastic pockets, capsules or bulk containers.

The Applicant has now found that the above filling method may be improved when the perforated plate and director blade are moved in a rotary fashion relative to each other. When such a rotary relationship exists between these two components, faster methods of filling are enabled including those operable on a continuous rotary basis.

SUMMARY OF THE INVENTION

According to one aspect of the present invention there is provided a method of loading container with a defined quantity of product which comprises:

a) closing off a perforation in a perforated plate;

b) directing powder into said closed-off perforation by the sweeping action of a first director blade spaced from said perforated plate; and c) transferring the contents of the perforation to said container, characterized by relative rotary motion of the perforated plate and said first director blade.

The present invention requires relative rotary motion of the perforated plate and the first director blade. That is to say, the perforated plate and first director blade move relative to each other and the motion is in a rotary sense.

It is not necessary that either the plate or the director blade be configured to rotate about the other. More typically, one component rotates about an axis and the other component either (a) held static at a defined radial point separate from that axis; or (b) rotates about second axis. In any case, it may be appreciated that the overall relative rotary motion will define a relative path (i.e. direction) of motion.

In one aspect, the first director blade is held static and the perforated plate moves in rotary fashion relative thereto.

In an alternative aspect, the perforated plate is held static and the first director blade moves in rotary fashion relative thereto.

In a further aspect, both of the first director blade and the perforated plate move in rotary fashion. In other words, both are rotated such as to also result in relative movement therebetween. Embodiments are envisaged in which the first (and any other) direction blade rotates at a different speed from that of the rotating perforated plate, but about common rotational axis. Other embodiments are envisaged in which the axes of rotation are different (e.g. perpendicular).

In one aspect, the perforated plate is in the form of a planar disk, particularly one that mountable for rotation about an axis. Suitably, the disk comprises plural perforations set out in circular fashion at a defined radial separation from the rotational axis. In one aspect the disk comprises plural sets of perforations arranged in circular fashion concentric each other at defined radial separations from the rotational axis.

The method requires closing off a perforation in a perforated plate. That is to say, it requires closing off open end of a perforation to form a well into which powder may then be directed.

In one aspect, the closing off is achievable by the use of a blanking plate.

In another aspect, the closing off is achievable by the use of a blanking pin inserted into the perforation. Preferably the blanking pin is moveable within the perforation to adjust the volume of the closed-off perforation.

In a further aspect, the closing off is achievable by placing a container in registration with the perforation.

Suitably, the diameter of the closed-off perforation is between 1.5 and 15 mm. The perforation may be a variety of shapes, such as square, circular, oval or rectangular.

The powder is directable by the action of the first director blade moving relative to the perforated plate. This relative movement creates a sweeping action, which acts such as to direct powder into a closed-off perforation.

Preferably, the first director blade (and any other director blade) presents a forward acute angle to the path of relative motion. The path of motion is defined by the relative rotary motion of the perforated plate and the first director blade. In this case, the angle between the direction of the (sweeping) path and the first (and any other) director blade is less than 90° (i.e. acute). Preferably the forward acute angle is between 1 and 60°. More preferably the forward acute angle is between 5 and 25°.

In a further aspect, the first (and any subsequent) director blade presents multiple forward acute angles to the path of relative motion. Such a first (or any subsequent) director blade is typically articulated or curved.

It is also possible, but less preferred to use a first (and any subsequent) director blade presenting a perpendicular or forward obtuse angle to the path of relative motion.

Optionally, the first director blade has plural movements relative to the perforated plate. The number of plural movements can be varied according to the flow properties of the powder to help ensure that the powder has a uniform density, resulting in more accurate dosing. Passing a director blade across the perforated plate more than once may in some circumstances be more economical than having multiple blades, although the time taken to fill the closed-off perforations may be greater than when using multiple blades.

Suitably, a thin layer of powder is left on the perforated plate after movement of the first director blade. Preferably the depth of said thin layer of powder is from 3 to 20 mm. More preferably the depth of said thin layer of powder is from 4 to 8 mm.

Suitably, the powder is directable by at least one subsequent director blade. Said at least one subsequent director blade and the perforated plate move in rotary fashion relative to each other. Preferably, the at least one subsequent director blade moves along the perforated plate at a lower level than that of the first director blade. This ensures that the at least one subsequent director blade can move through the thin layer of powder left by the first director blade and not just along the surface of the powder.

Suitably, the distance between the level of movement of the first director blade and the at least one subsequent director blade is 0 to 12 mm. More preferably, the distance between the level of movement of the first director blade and the at least one subsequent director blade is 1 to 3 mm. A second subsequent director blade would move along the perforated plate at a lower level to that of a first subsequent director blade.

An additional aspect of the present invention comprises removing excess powder from said perforated plate subsequent to directing powder into the perforation. Preferably the excess powder is removed by the action of a wiper. It will be appreciated that typically said wiper and the perforated plate are moving in a relative rotary sense. The wiper is typically a blade composed of stainless steel and moves in close proximity to the surface of the perforated plate to ensure that excess powder is not transferred to the blind cavity.

Suitably, the contents of the perforation are transferable by the action of a transfer pin. The pin is inserted into the perforation, transferring the powder through to the container.

Suitably, the direction of powder into the closed-off perforation and transfer into the blind cavity is a continuous step.

In one aspect, transfer of the contents of the perforation to the container comprises:

a) reopening the perforation;

b) placing the container in registration with the perforation; and c) transferring the contents of the perforation into the container.

In another aspect, the contents of the perforation are transferable by the action of a vacuum system. Preferably the vacuum comprises a vacuum head and at least one vacuum cup.

An additional aspect of the present invention comprises compacting the powder in the perforation.

Suitably, the powder is compacted to a volume of between 50 and 100%, for example 70 to 90%, of the original volume of powder in the closed-off perforation.

Suitably, the powder is compactable by the action of a compacting pin. Suitably, the transfer pin and the compacting pin are integral. More preferably the transfer pin and the compacting pin are identical.

Suitably, the container is a blind cavity. Preferably, the blind cavity is selected from the group consisting of a blister pocket, an injection moulded plastic pocket, a capsule and a bulk container. A blister pocket or injection moulded plastic pocket may form part of an elongate strip used in inhalation devices.

An additional aspect of the present invention comprises applying a lid to the container to protect the contents therein. The lid may then be sealed to the container.

In a particular aspect there is provided, a method of loading each of plural blisters arranged in series on an elongate blister strip with a defined quantity of product which comprises:

a) closing off plural perforations in a perforated plate, said plural perforations being arranged in series;

b) directing powder into said plural closed-off perforations by the sweeping action of a first director blade spaced from said perforated plate; and c) transferring the contents of each of the perforations to a corresponding blister of said elongate blister strip, characterized by relative rotary motion of the perforated plate and said first director blade.

Suitably, in the transferring step, each perforation of the perforated plate is serially brought into registration with the corresponding blister of the blister strip. Preferably, at the point of registration the perforated plate is rotating and the blister strip is moving on a linear path.

Suitably, the perforated plate is in the form of a planar disk, particularly one that is mountable for rotation about an axis. Suitably, the disk comprises plural perforations set out in circular fashion at a defined radial separation from the rotational axis. In one aspect, the disk comprises plural sets of perforations arranged in circular fashion concentric to each other at defined radial separations from the rotational axis.

In one aspect, each blister of the elongate strip is serially brought into registration with a corresponding perforation on the disk by relative movement of the blister strip in relation to the circular series of perforations on the disk. Embodiments are envisaged in which the disk moves and the strip is kept still or in which the disk is kept still and the strip moves or preferably, in which both the disk and the strip are moving (e.g. disk rotating and strip moving in linear fashion to bring about the desired registration).

Suitably, the powder comprises a medicament. Preferably the medicament is selected from the group consisting of albuterol, salmeterol, fluticasone propionate and beclomethasone dipropionate and salts or solvates thereof and any mixtures thereof. A preferred combination comprises salmeterol xinafoate and fluticasone propionate. Optionally, excipient such as lactose or another sugar may be present together with the medicament.

According to another aspect of the present invention there is provided an apparatus for loading a container with a defined quantity of product, which comprises:

a) a perforated plate;

b) a closure for reversibly closing off a perforation in the perforated plate;

c) a director for directing powder into said closed-off perforation, said director comprising a first director blade spaced from the perforated plate; and d) a transferor for transferring the contents of the perforation to said container, wherein the perforated plate and said first director blade are movable in a relative rotary fashion.

In one aspect, the first director blade is held static and the perforated plate is movable rotary fashion relative thereto.

In another aspect, the perforated plate is held static and the first director blade is movable in rotary fashion relative thereto.

In a further aspect, both of the first director blade and the perforated plate are movable rotary fashion. Different co-rotatory embodiments are envisaged, as described hereinbefore.

The perforated plate forms the basis for a powder reservoir and may have sidewalls to form a (walled) container suitable for holding powder.

In one aspect, the perforated plate is in the form of a planar disk, particularly one that is mountable for rotation about an axis. Suitably, the disk comprises plural perforations set out in circular fashion at a defined radial separation from the rotational axis. In one aspect, the disk comprises plural sets of perforations arranged in circular fashion concentric to each other at defined radial separations from the rotational axis. Circumferential powder-retaining walls may be provided to the disk.

In one aspect, the closure comprises a blanking plate.

In another aspect, the closure comprises a blanking pin inserted into the perforation. Suitably the blanking pin is moveable within the perforation to adjust the volume of the perforation.

In a further aspect, the closure comprises the container placed in registration with the perforation.

Suitably, the diameter of the closed-off perforation is between 1.5 and 15 mm. The perforation may be a variety of shapes, such as square, circular, oval or rectangular.

Suitably, the first (and any subsequent) director blade presents a forward acute angle to the path of relative motion. Preferably, the forward acute angle is between 1 and 60° such as between 5 and 25°.

Suitably, the first (and any subsequent) director blade presents multiple forward acute angles to the linear sweeping path.

In one aspect, the first (and any subsequent) director blade is curved in form.

In another aspect, the first (and any subsequent) director blade is articulated in form.

Suitably, the first (and any subsequent) director blade has a flat tail section.

Suitably, the first director blade is positioned to leave a gap of between 3 and 20 mm between the first director blade and the perforated plate. More preferably the first director blade is positioned to leave a gap of between 4 and 8 mm between the first director blade and the perforated plate.

Suitably, the director comprises at least one subsequent director blade. In use, the perforated plate and said at least one subsequent director blade are characterized by rotary relative action. Suitably, the at least one subsequent director blade is positioned closer to the perforated plate than the first director blade. Preferably, the at least one subsequent director blade is positioned 0 to 12 mm closer to the perforated plate than the first director blade. More preferably the at least one subsequent director blade is positioned 1 to 3 mm closer to the perforated plate than the first director blade. A second subsequent director blade would move along the perforated plate at a lower level to that of a first subsequent director blade.

In one aspect, the transferor comprises a transferor pin.

In another aspect, the transferor comprises a vacuum system. Suitably the vacuum system comprises a vacuum head and a series of vacuum cups.

An additional aspect of the present invention comprises a compactor for compacting the powder in the perforation. Suitably, the compactor comprises a compactor pin.

Suitably, the transferor and compactor are integral. More preferably the transferor and compactor are identical.

An additional aspect of the present invention comprises registration means for registering the container (i.e. bringing it into registration) with the perforation.

An additional aspect of the present invention comprises a powder remover for removing excess powder from the perforated plate subsequent to action of the powder director. Suitably, the powder remover comprises a wiper. In use, the wiper and the perforated plate are in rotary relative motion. The wiper is typically a blade composed of stainless steel and moves in close proximity to the surface of the perforated plate to ensure that excess powder is not transferred to the blind cavity.

Suitably, the container is a blind cavity. Preferably, the blind cavity is selected from the group consisting of a blister pocket, an injection moulded plastic pocket, a capsule and a bulk container. A blister pocket or injection moulded plastic pocket may form part of an elongate strip used in inhalation devices.

An additional aspect of the present invention comprises a lid applier for applying a lid to the container to protect the contents (e.g. powder) thereof.

In one aspect, the container comprises a blister pack in laminate form. Suitably, the laminate comprises material selected from the group consisting of metal foil, organic polymeric material and paper. Suitable metal foils include aluminium or tin foil having a thickness of from 5 to 100 μm, preferably from 10 to 50 μm, such as 20 to 30 μm.

Suitable organic polymeric materials include polyethylene, polypropylene, polyvinyl chloride and polyethylene terephthalate.

Access to the medicament product comprised within the pockets of the elongate strip form container is by any suitable access means including tearing, piercing or peeling apart the relevant pockets.

One suitable blister pack form medicament container comprises a peelable blister strip. Suitably, the peelable blister strip comprises a base sheet in which blisters are formed to define pockets therein for containing distinct medicament dose portions and a lid sheet which is hermetically sealed to the base sheet except in the region of the blisters in such a manner that the lid sheet and the base sheet can be peeled apart. The base and lid sheets are typically sealed to one another over their whole width except for the forward end portions where they are typically not sealed to one another at all. Thus, separate base and lid sheet forward end portions are presented at the end of the strip. The respective base and lid sheets are peelably separable from each other to (e.g. separately) release the contents of each pocket.

Suitably, the lid sheet comprises at least the following successive layers: (a) paper; adhesively bonded to (b) polyester; adhesively bonded to (c) aluminium foil; that is coated with a heat seal lacquer for bonding to the base sheet. The thickness of each layer may be selected according to the desired properties but is typically of the order of from 5 to 200 micron, particularly from 10 to 50 micron.

Suitably, the base sheet comprises at least the following successive layers: (a) oriented polyamide (OPA); adhesively bonded to (b) aluminium foil; adhesively bonded to (c) a third layer comprising a polymeric material (e.g. polyvinyl chloride).

Various known techniques can be employed to join the lid and base sheet and hence to seal the blisters of the peelable blister strip. Such methods include adhesive bonding, hot metal bonding, hot metal welding, radio frequency welding, laser welding, ultrasonic welding and hot bar sealing. The lid sheet and base sheet of the peelable blister strip are particularly sealable by 'cold form' sealing methods, which are conducted at lower temperatures than conventional heat sealing methods. Such 'cold form' sealing methods are of particular utility where the medicament or medicament formulation for containment within the blister is heat sensitive (e.g. degrades or denatures on heating). Suitable 'cold form' sealing methods are conducted at a temperature in the range of 150-250° C., more preferably, 210-240° C.

According to a particular aspect there is provided an apparatus for loading each of plural blisters arranged in series on an elongate blister strip with a defined quantity of product, which comprises:

a) a perforated plate having plural perforations therein, said plural perforations being arranged in series;
b) a closure for reversibly closing off each of said plural perforations in the perforated plate;
c) a director for directing powder into each of said closed-off perforations, said director comprising a first director blade spaced from the perforated plate; and
d) a transferor for transferring the contents of each of the perforations to a corresponding blister of said elongate blister strip, wherein the perforated plate and said first director blade are movable in a relative rotary fashion.

Suitably, the apparatus additionally comprises registration means to serially guide each perforation of the perforated plate into registration with a corresponding blister of the blister strip.

Suitably, the apparatus additionally comprises rotational means to rotate the perforated plate and moving means to move the blister strip in linear fashion. At the point of registration, the perforations of the plate are therefore rotating serially and the blisters of the blister strip are moving serially in linear fashion. For good registration, the linear velocities of the perforations and blisters must be matched.

Suitably, the apparatus further comprises powder. Preferably, the powder comprises a medicament. Preferably, the medicament is selected from the group consisting of albuterol, salmeterol, fluticasone propionate and beclomethasone dipropionate and salts or solvates thereof and any mixtures thereof. A preferred combination comprises salmeterol xinafoate and fluticasone propionate.

The invention also provides a container loaded with powder product obtainable by the method as herein described.

BRIEF DESCRIPTION OF THE DRAWINGS

The invention will now be described with reference to the accompanying drawings in which.

DETAILED DESCRIPTION OF THE DRAWINGS

Figure 1A:
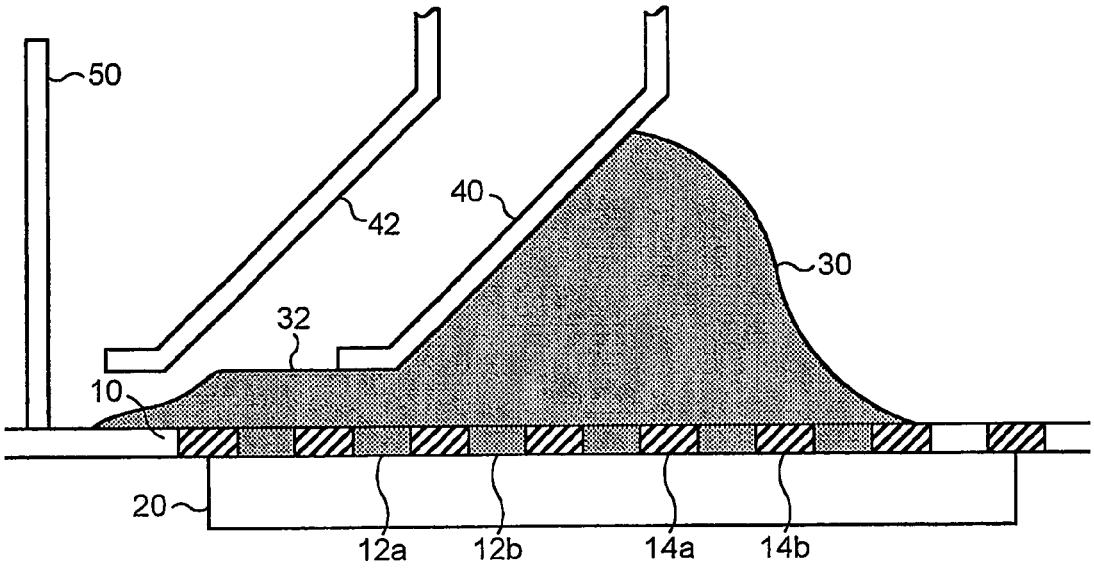
FIGS. 1*a*, 1*b* and 1*c* show the first stage in a filling method in accord with the present invention.
Figure 1B:
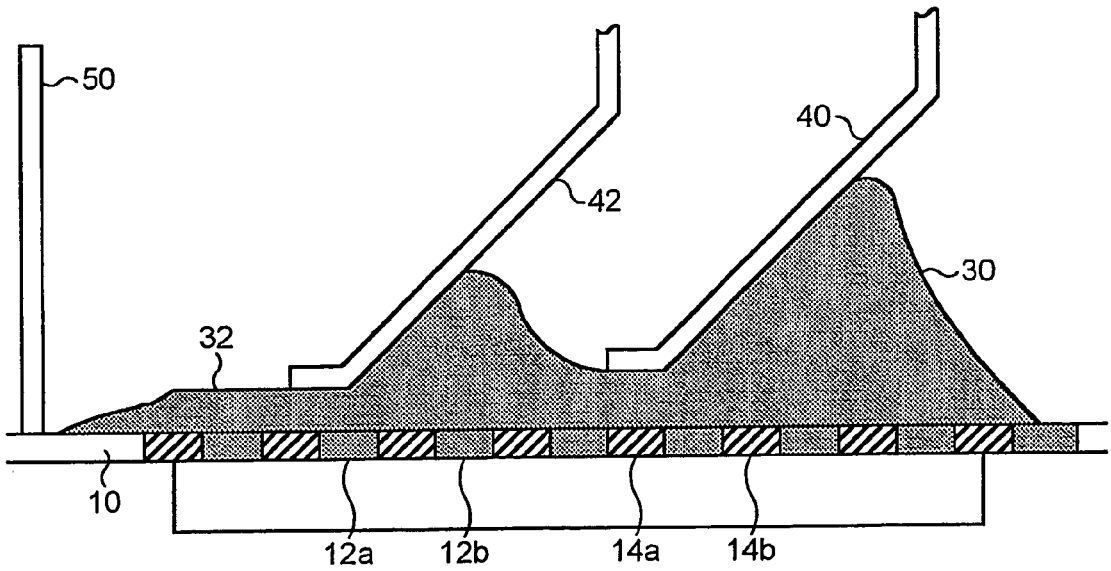
Figure 1C:
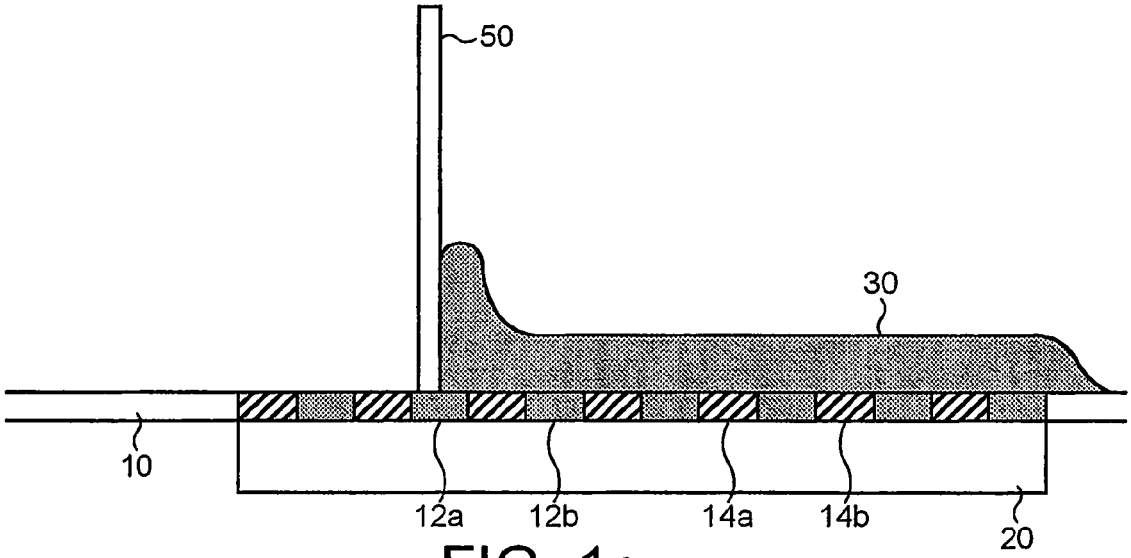

FIGS. 1*a*, 1*b* and 1*c* show the first stages in a filling method herein. A rotationally mounted (mounting not visible) perforated plate 10 in contact with a blanking plate 20 creates closed-off perforations 12*a*, 12*b*, which (not visible in side view) are in rotary series (i.e. spaced radially from the axis of rotation of the perforated plate 10). On the opposite side of the perforated plate 10 to the blanking plate 20 is a reservoir of powder 30. The powder 30 comprises a suitable medicament formulation. Situated above the powder reservoir are director blades 40, 42 and wiper blade 50. The director blades may be seen to have following tail sections.

The director blades 40, 42 (i.e. first director blade 40, and subsequent director blade 42) are shown mounted at an angle of approximately 45° to the perforated plate 10. It should however be appreciated that the director blades 40, 42 may be mounted at any angle within a wide range, typically (but not exclusively) at an acute angle and preferably between 1 and 60°, and may be varied according to the properties of the powder to optimise powder direction. When the blades are angled at an acute angle they exert a compressive force on the powder which produces a powder bed with a more uniform density than using perpendicular blades. It should be appreciated that curved or articulated blades may alternatively be used. The tail sections of the director blades 40, 42 are not essential to their action although they may also be angled and exert a further compressive force on the powder. The wiper blade 50 is shown mounted at an angle of approximately 90° to the perforated plate 10, however effective operation of the wiper 50 can be obtained within a wide range of angles.

The powder 30 is directed into the perforations 12*a*, 12*b* on rotation of the perforated plate 10 by the action of static director blades 40,42 which thereby move through the powder reservoir 30 on a sweeping rotary path, moving the powder 30 along the rotating perforated plate 10. The first director blade 40 moves through the powder reservoir 30 leaving a thin layer of excess powder 32 still in contact with the perforated plate 10. The second director blade 42 moves relative to the perforated plate 10 at a lower level than the first director blade 40, moving through the thin layer of excess powder 32 and directing powder 30 into any spaces in the perforations 12*a*, 12*b* not filled by the action of the first director blade 40. Additional director blades may follow the second director blade 42 if required. Alternatively, the director blades 40, 42 may be passed through the powder reservoir 30 more than once if the powder has poor flow properties. A static wiper 50, typically a blade composed of stainless steel, mounted in rotary series with the two director blades 40, 42 then moves through the powder reservoir 30 in close proximity to the surface of the rotating perforated plate 10, removing the excess powder 32 from the perforated plate surface 10.

Figure 2:
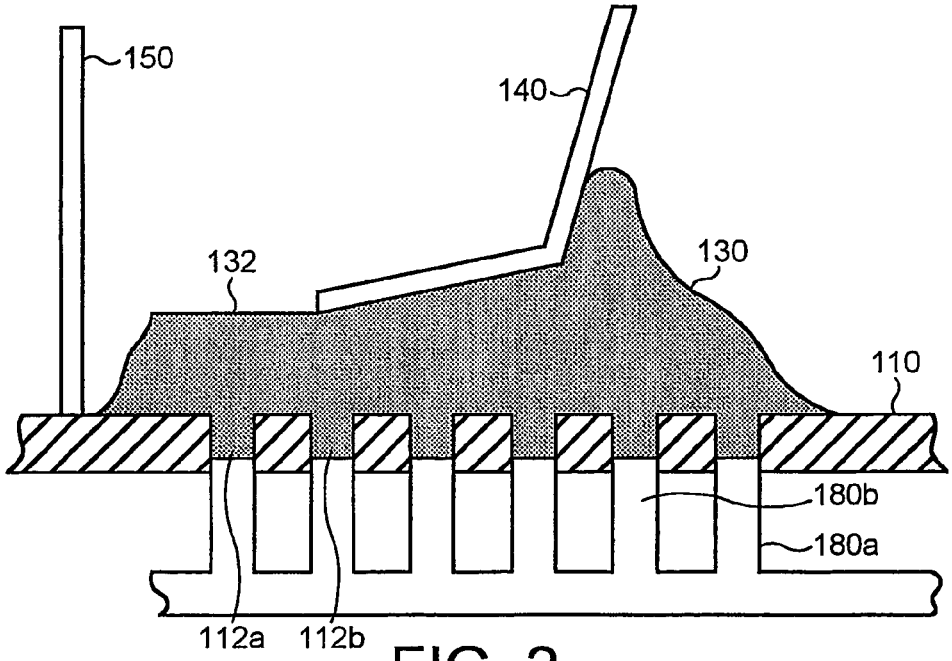
FIG. 2 shows the first stage in an alternative filling method in accord with the present invention.

FIG. 2 shows the first stage in an alternative filling method herein. Blanking pins 180*a*, 180*b* are inserted into a rotatable perforated plate 110 to create closed-off perforations 112*a*, 112*b*. The blanking pins 180*a*, 180*b* and closed-off perforations 112*a*, 112*b* are each in corresponding rotary series. The volume of the closed-off perforations 112*a*, 112*b* may be varied by varying the insertion depth of the blanking pins 180*a*, 180*b*. On the opposite side of the perforated plate 110 to the blanking pins 180*a*, 180*b* is a reservoir of powder 130. The powder 130 comprises a suitable medicament formulation. The powder 130 is directed into the perforations 112*a*, 112*b* (as shown in FIGS. 1*a* and 1*b*) by the action of a director blade 140 which moves across the powder reservoir 130 on a rotary path as the perforated plate 110 is rotated and moves the powder 130 along the perforated plate 110, leaving a thin layer of excess powder 132 still in contact with the perforated plate 110. The director blade shown illustrates a blade with a longer tail section than the blades shown in FIGS. 1*a*, 1*b* and 1*c* and this tail section is shown angled at about 10° to the rotary path. However it should be appreciated that any blade in accord with the present invention may be used to fill the perforations closed off by the blanking pins. A wiper 150 follows the director blade 140 (as shown in FIG. 1*c*) and moves radially along the powder reservoir 130 in close proximity to the surface of the perforated plate 110, removing the excess powder 132 from the perforated plate surface 110.

Figure 3:
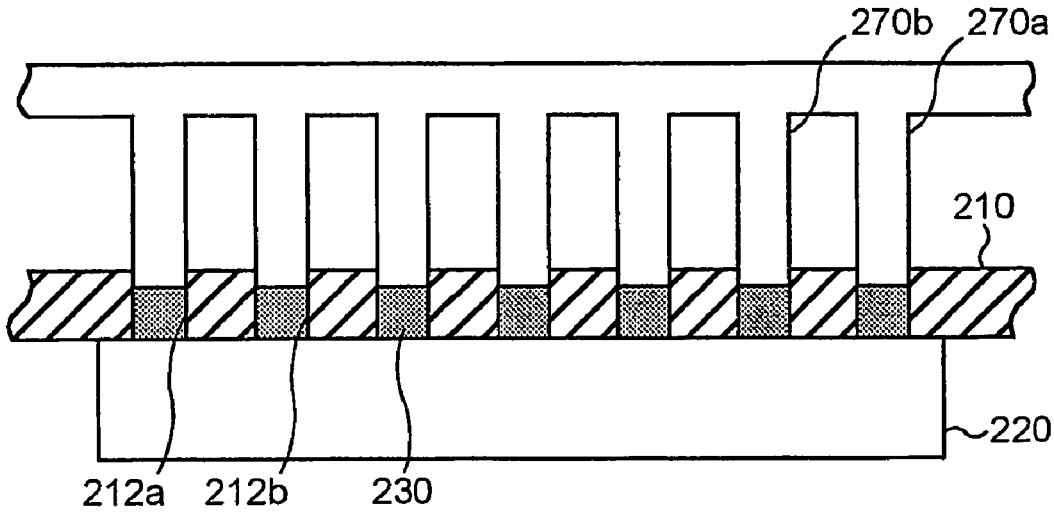
FIG. 3 shows an optional subsequent compaction stage in the filling method of FIGS. 1*a*, 1*b*, 1*c* and 2.

FIG. 3 shows an optional subsequent stage to FIGS. 1*a*, 1*b* 1*c* and FIG. 2 in which compaction pins 270*a*, 270*b* (mounted in rotary series) are inserted into the closed-off perforations 212*a*, 212*b* (also in rotary series) to compact the powder 230 held within the perforation 212*a*, 212*b*. The figure shows a blanking plate 220 acting to close off the perforations as in FIGS. 1*a*, 1*b* and 1*c* however it should be appreciated that this stage is also applicable to the situation where blanking pins are used to close off the perforations as in FIG. 2. The blanking plate 220 may then be removed from its position in contact with the perforated plate 210 or the blanking pins removed from the closed-off perforations 212*a*, 212*b*. The powder 230 generally has poor flow properties and therefore remains in the perforations 212*a*, 212*b*.

Figure 3A:
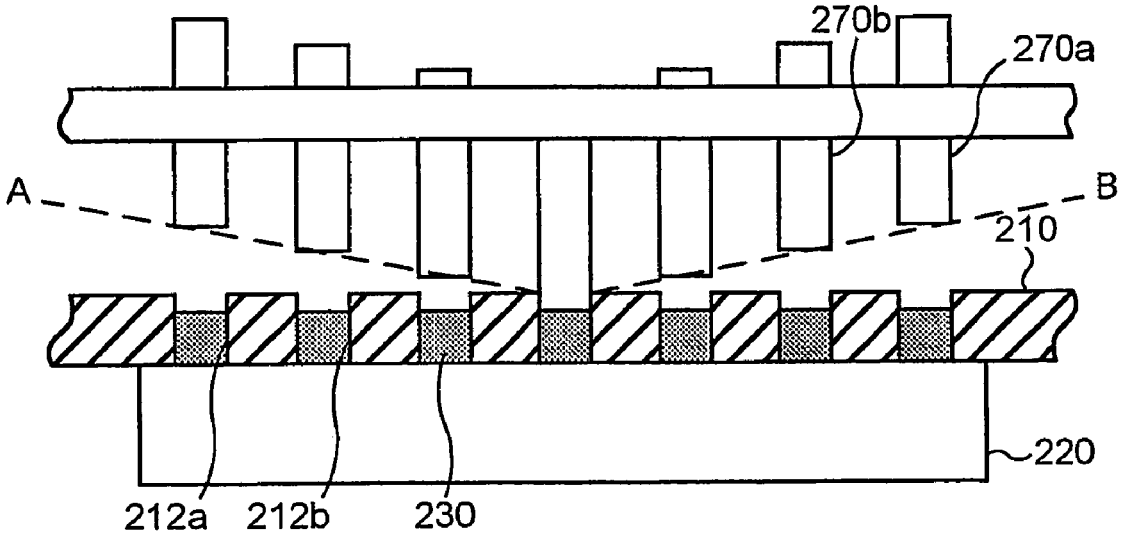
FIG. 3A shows a variation of the embodiment of FIG. 3.

FIG. 3A shows a variation of the embodiment of FIG. 3 in which the compaction pins 270*a*, 270*b* (only two labelled for clarity) have piston drive mechanisms, which enable the pins 270*a*, 270*b* to be sequentially lowered in a cascade pattern (e.g. sinusoidal pattern) as the perforations 212*a*, 212*b* are rotated past. Dotted line A-B shows a snapshot of the cascade pattern wherein the pins cascade in the direction from A to B, such that at point A the pin is moving down to the plate 210 and at point B it is moving away from the plate 210.

Figure 4:
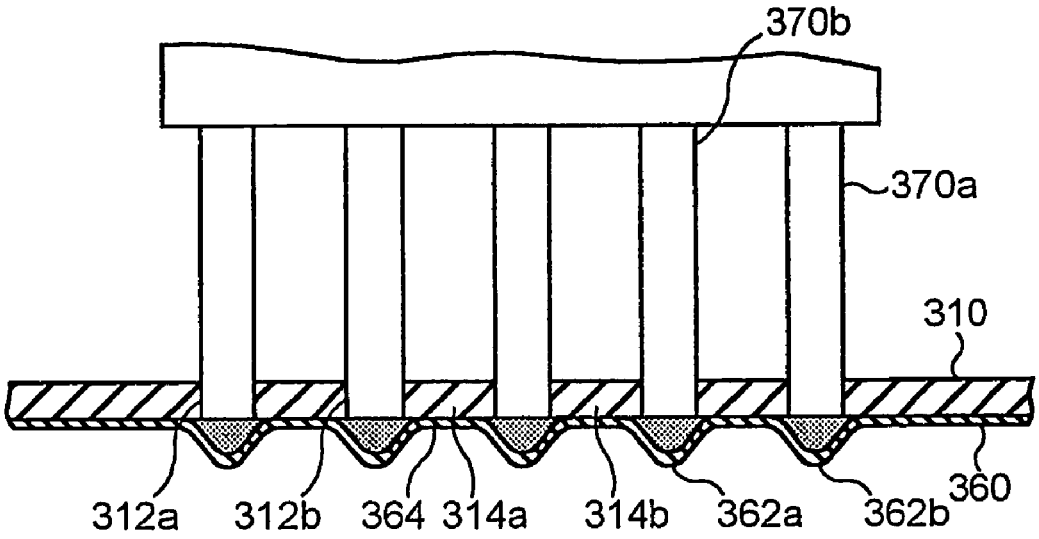
FIG. 4 shows a subsequent transfer stage in the filling method of FIGS. 1*a*, 1*b*, 1*c* and 2.

FIG. 4 shows a further stage to FIGS. 1*a*, 1*b*, 1*c*, 2 and 3 in which a blister strip 360 is moved so that it is positioned with blister pockets 362*a*, 362*b* into registration with the perforations 312*a*, 312*b*, which are in rotary series. It will be appreciated that for a linear blister strip 360 (i.e. having multiple pockets 362*a*, 362*b* in linear series) the registration with the perforations 312*a*, 312*b* in rotary series may not be exact at all points, but that for a rotary series of sufficient radial characteristic approximate registration is achievable for a certain number (e.g. three or five) of pockets (e.g. see description of Stage C of FIG. 8). The solid sections 314*a*, 314*b* of the perforated plate 310 mask the surface surrounding the pockets 364. The radially mounted transfer pins 370*a*, 370*b* are inserted through the perforated plate 310 and the powder 330 is transferred to the blister pockets 362*a*, 362*b*. The filled blister strip 360 is then lowered and the pins 370*a*, 370*b* raised. The blanking plate 320 is relocated against the underside of the perforated plate 310, creating closed-off perforations 312*a*, 312*b*, which are filled with powder 330 in the next cycle.

It should be appreciated that the powder can also be transferred to other types of container, for example an injection moulded container, a capsule or other form of blind cavity.

The blister strip 360 of FIG. 4 may be sealed by applying a lid sheet and providing sealing means so that the powder is contained in a medicament container defined by the pocket and elongate strip. Suitable methods of sealing the medicament carrier include the use of adhesives, staples or stamps and welding methods selected from hot metal welding, radio frequency welding and ultrasonic welding. Such sealing techniques may be used to form a suitable seal around the periphery of the medicament pocket which is capable of being peeled away by the patient or by a suitable trigger release mechanism in a controlled manner when in use.

Figure 4A:
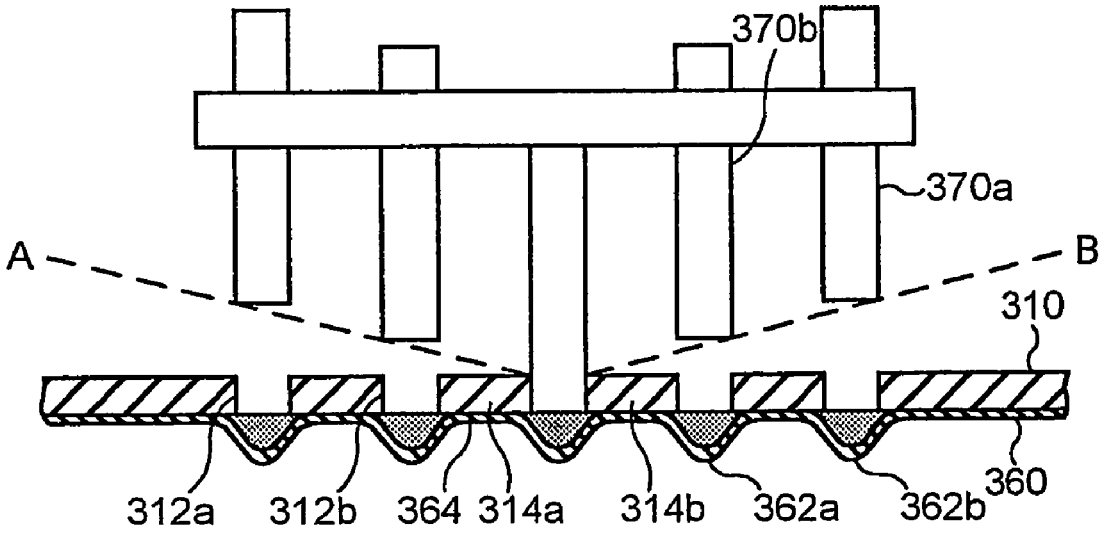
FIG. 4A shows a variation of the embodiment of FIG. 4.

FIG. 4A shows a variation of the embodiment of FIG. 4 in which the transfer pins 370*a*, 370*b* (only two labelled for clarity) have piston drive mechanisms, which enable the pins 370*a*, 370*b* to be sequentially lowered in a cascade pattern (e.g. sinusoidal pattern) as the perforations 312*a*, 312*b* are rotated past. Dotted line A-B shows a snapshot of the cascade pattern, wherein as in FIG. 3A the pins move in cascade fashion in the direction A to B.

Figure 5A:
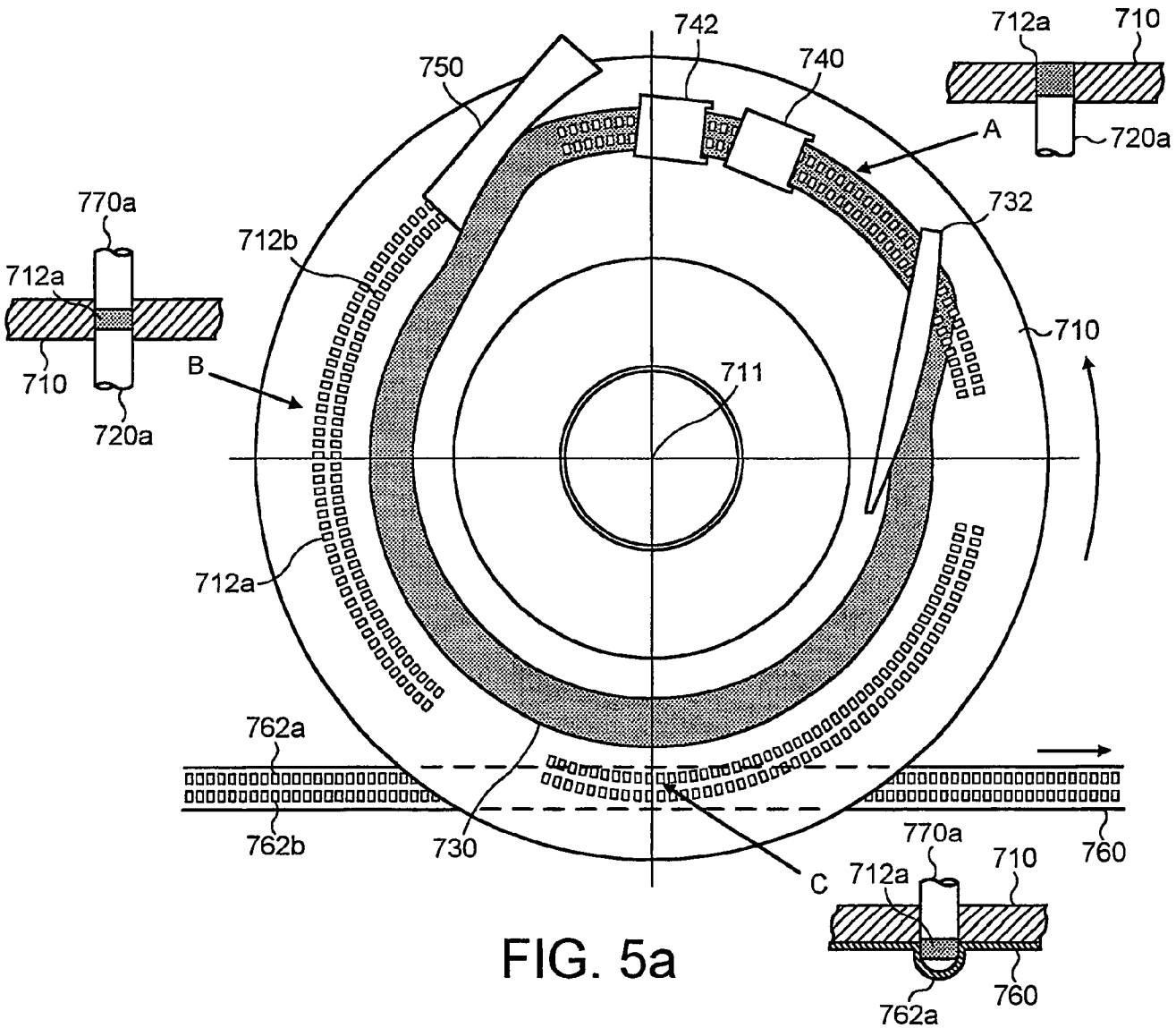
FIG. 5*a* shows rotary filling apparatus in accord with the present invention.
Figure 5B:
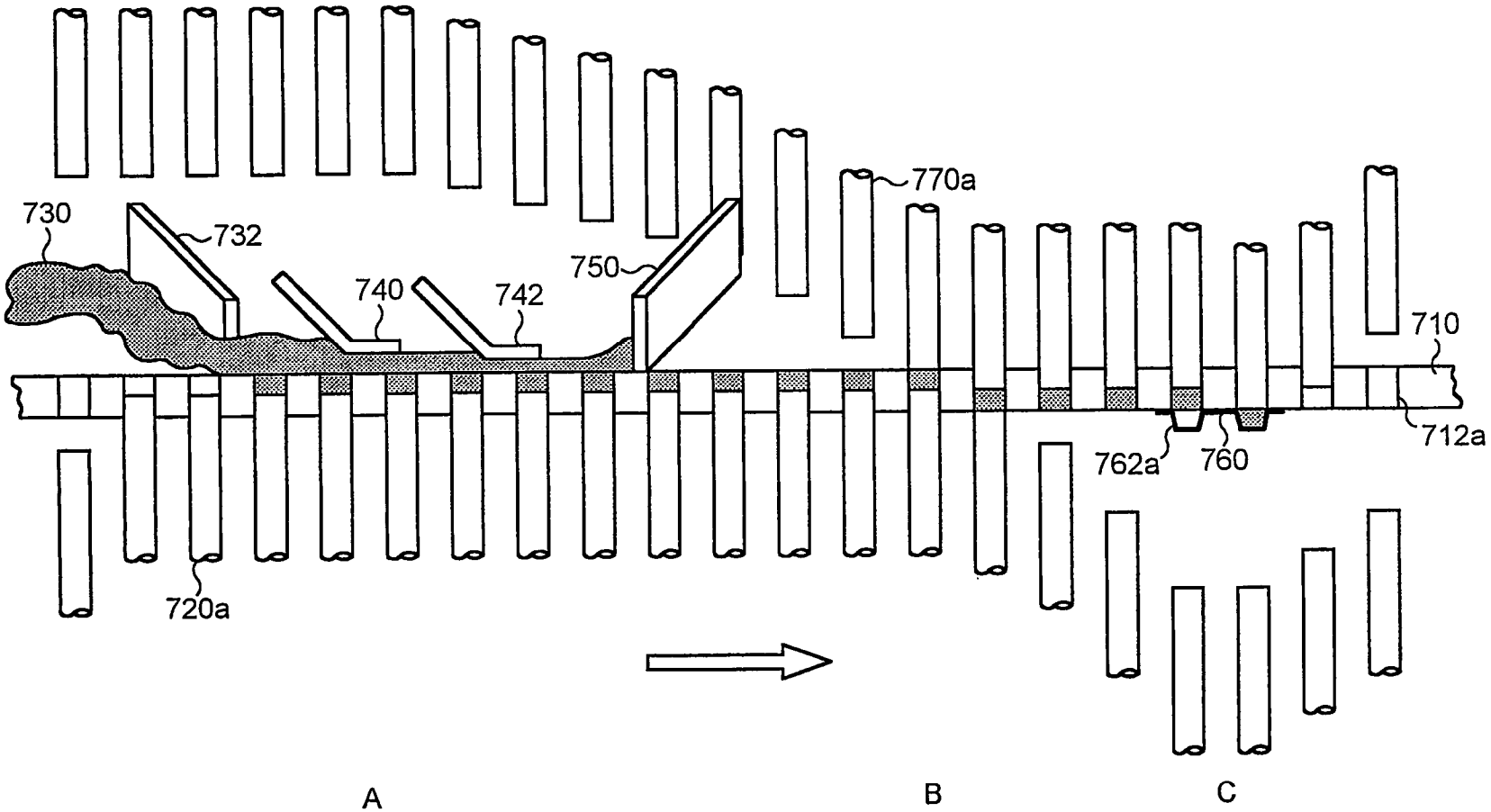
FIG. 5*b* shows a schematic (flattened out) side view of the rotary apparatus of FIG. 5*a*.

FIG. 5*a* shows in top-view an apparatus suitable for use in the filling method herein. FIG. 5*b* shows the apparatus of FIG. 5*a* in a schematic, flattened out view (i.e. the view along the circumference of the apparatus, as if flattened out). The apparatus comprises a circular stainless steel plate (disk) 710 mounted for rotation about axis 711. The plate 710 is provided with three angularly spaced sets (only one labelled for clarity) of dual radial series 712*a*, 712*b* of sixty perforations arranged concentrically at a position spaced from the perimeter of the plate 710. A reservoir of powder 730 is provided to the plate 710 and guided by guide blades 732, 750 to adapt a particular configuration on the plate 710 dependent on the stage in the rotational cycle thereof.

The operation of the apparatus involves three distinct stages labelled A, B and C in both of FIGS. 5*a* and 5*b* and illustrated in more detail in the corresponding cutaway drawings of FIG. 5*a*. It will be appreciated that the three stages are sequential (direction of rotation indicated on both Figures) and dependent on the experienced stage in the rotational cycle of the plate 710.

At Stage A, the filling stage, blanking pins 720*a* are brought upwards to close off the bottom of each perforation 712*a* of the plate (one closed-off perforation 712*a* shown in cutaway). Powder 730 is guided towards the closed off perforations 712*a*, 712*b* by the action of guide blade 732. Subsequent director blades 740, 742 then direct the powder firmly into the closed off perforations 712*a*, 712*b*. It may be seen on FIG. 5*b* that the director blades 740, 742 each present a forward acute angle to the powder bed 730. Excess powder 730 is removed from the surface of the plate 710 adjacent to the filled closed off perforations 712*a*, 712*b* by the wiping action of wiping guide blade 750. It may be appreciated that Stage A of FIGS. 5*a* and 5*b* corresponds in essential function to the filling step of FIG. 2 and that the filling step of FIGS. 1*a*, 1*b* and 1*c* may be used in alternative embodiments.

At Stage B, the compaction stage, the blanking pins 720*a* at the bottom of each perforation 712*a* of the plate (one closed-off perforation 712*a* shown in cutaway on FIG. 5*a*) remain in place. Compaction pins 770*a* are now introduced into the top of each closed-off perforation 712*a* to compact the powder therein. The degree (e.g. force) of compaction will depend on whether the ultimate product is intended to be a free-flowing powder, or alternatively a more dense powder. It may be appreciated that Stage B of FIGS. 5*a* and 5*b* is analogous to the compaction steps of FIGS. 3 and 3A, which detailed features may be used in alternative embodiments herein.

At Stage C, the transfer stage, the blanking pins 720*a* are first withdrawn to expose the bottom of each perforation 712*a* of the plate 710 (one perforation 712*a* shown in cutaway on FIG. 5*a*). The dual series of sixty blisters 762*a*, 762*b* of blister strip 760 are then sequentially brought into registration with the exposed bottom of the corresponding series of filled perforations 712*a*, 712*b*. It will be appreciated that this is achieved by moving the blister strip 760 on a linear path as shown. The compacted powder in the closed off perforations 712*a*, 712*b* is then transferred into the blisters 762*a*, 762*b* of the blister strip 760 by the action of transfer pin 770*a*, which is inserted deep into the perforation 712*a*. It may be appreciated that Stage C of FIGS. 5*a* and 5*b* is analogous to the compaction steps of FIGS. 4 and 4A, which detailed features may be used in alternative embodiments herein.

It may also be appreciated that because the linear velocity of the two radial series of perforations 712*a*, 712*b* will differ slightly (although they share the same angular velocity) care is needed at Stage C in achieving a suitable registration with the corresponding series of blisters 762*a*, 762*b*, which of course, share the same linear velocity. Variations are envisaged in which the perforations 712*a*, 712*b* of the two radial series are slightly offset from each other to part compensate for this factor. Other variations are envisaged in which the relative size of the perforations 712*a*, 712*b* to the blisters 762*a*, 762*b* is selected in order to ensure an acceptable degree of registration (i.e. that which is sufficient to ensure effect transfer of compacted powder).

Post-filling, the blister strip 760 of FIGS. 5*a* and 5*b* is sealed by applying a lid sheet and providing sealing means so that the powder is contained within the strip 760. Suitable methods of sealing have been described hereinbefore.

The co-ordinated, cascade flowing movement of the blanking pins 720*a* and compaction pins 770*a* through the rotary cycle (i.e. through Stages A to C) may be appreciated by reference to FIG. 5*b*.

It may be appreciated that any of the parts of the filling apparatus or container that contact the powdered medicament may be coated with materials such as fluoropolymer materials (e.g. PTFE or FEP) which reduce the tendency of medicament to adhere thereto. Any movable parts may also have coatings applied thereto which enhance their desired movement characteristics. Frictional coatings may therefore be applied to enhance frictional contact and lubricants (e.g. silicone oil) used to reduce frictional contact as necessary.

The invention is suitable for filling blister packs, or other suitable containers, with powdered medicament, particularly for the treatment of respiratory disorders such as asthma and chronic obstructive pulmonary disease (COPD), bronchitis and chest infections.

Appropriate medicaments may thus be selected from, for example, analgesics, e.g., codeine, dihydromorphine, ergotamine, fentanyl or morphine; anginal preparations, e.g., diltiazem; antiallergics, e.g., cromoglycate (e.g. as the sodium salt), ketotifen or nedocromil (e.g. as the sodium salt); antiinfectives e.g., cephalosporins, penicillins, streptomycin, sulphonamides, tetracyclines and pentamidine; antihistamines, e.g., methapyrilene; anti-inflammatories, e.g., beclomethasone (e.g. as the dipropionate ester), fluticasone (e.g. as the propionate ester), flunisolide, budesonide, rofleponide, mometasone e.g. as the furoate ester), ciclesonide, triamcinolone (e.g. as the acetonide) or 6α, 9α-difluoro-11β-hydroxy-16α-methyl-3-oxo-17α-propionyloxy-androsta-1,4-diene-17β-carbothioic acid S-(2-oxo-tetrahydro-furan-3-yl) ester; antitussives, e.g., noscapine; bronchodilators, e.g., albuterol (e.g. as free base or sulphate), salmeterol (e.g. as xinafoate), ephedrine, adrenaline, fenoterol (e.g. as hydrobromide), formoterol (e.g. as fumarate), isoprenaline, metaproterenol, phenylephrine, phenylpropanolamine, pirbuterol (e.g. as acetate), reproterol (e.g. as hydrochloride), rimiterol, terbutaline (e.g. as sulphate), isoetharine, tulobuterol or 4-hydroxy-7-[2-[[2-[[3-(2-phenylethoxy)propyl]sulfonyl]ethyl]amino]ethyl-2(3H)-benzothiazolone; adenosine 2a agonists, e.g. 2R,3R,4S,5R)-2-[6-Amino-2-(1S-hydroxymethyl-2-phenyl-ethylamino)-purin-9-yl]5-(2-ethyl-2H-tetrazol-5-yl)-tetrahydro-furan-3,4-diol (e.g. as maleate); $\alpha_4$ integrin inhibitors e.g. (2S)-3-[4-({[4-(aminocarbonyl)-1-piperidinyl]carbonyl}oxy)phenyl]-2-[((2S)-4-methyl-2-{[2-(2-methylphenoxy) acetyl]amino}pentanoyl)amino] propanoic acid (e.g. as free acid or potassium salt), diuretics, e.g., amiloride; anticholinergics, e.g., ipratropium (e.g. as bromide), tiotropium, atropine or oxitropium; hormones, e.g., cortisone, hydrocortisone or prednisolone; xanthines, e.g., aminophylline, choline theophyllinate, lysine theophyllinate or theophylline; therapeutic proteins and peptides, e.g., insulin or glucagon; vaccines, diagnostics, and gene therapies. It will be clear to a person skilled in the art that, where appropriate, the medicaments may be used in the form of salts, (e.g., as alkali metal or amine salts or as acid addition salts) or as esters (e.g., lower alkyl esters) or as solvates (e.g., hydrates) to optimise the activity and/or stability of the medicament.

Preferred medicaments are selected from albuterol, salmeterol, fluticasone propionate and beclomethasone dipropionate and salts or solvates thereof, e.g., the sulphate of albuterol and the xinafoate of salmeterol.

Preferred components of combinations of active ingredients contain a bronchodilator in combination with an anti-inflammatory. The bronchodilator is suitably a beta-agonist, particularly a long-acting beta-agonist (LABA). Suitable bronchodilators include salbutamol (e.g., as the free base or the sulphate salt), salmeterol (e.g., as the xinafoate salt) and formoterol (eg as the fumarate salt). The anti-inflammatory is suitably an anti-inflammatory steroid. Suitably anti-inflammatory compounds include a beclomethasone ester (e.g., the dipropionate), a fluticasone ester (e.g., the propionate) or budesonide or any salt or solvate thereof. One preferred combination of components comprises fluticasone propionate and salmeterol, or any salt or solvate thereof (particularly the xinafoate salt). A further combination of components of particular interest is budesonide and formoterol or any salt or solvate thereof (e.g. formoterol as the fumarate salt).

Generally, powdered medicament particles suitable for delivery to the bronchial or alveolar region of the lung have an aerodynamic diameter of less than 10 micrometers, preferably less than 6 micrometers. Other sized particles may be used if delivery to other portions of the respiratory tract is desired, such as the nasal cavity, mouth or throat. The medicament may be delivered as pure drug, but more appropriately, it is preferred that medicaments are delivered together with excipients (carriers) which are suitable for inhalation. Suitable excipients include organic excipients such as polysaccharides (i.e. starch, cellulose and the like), lactose, glucose, mannitol, amino acids, and maltodextrins, and inorganic excipients such as calcium carbonate or sodium chloride. Lactose is a preferred excipient.

Particles of the powdered medicament and/or excipient may be produced by conventional techniques, for example by micronisation, milling or sieving. Additionally, medicament and/or excipient powders may be engineered with particular densities, size ranges, or characteristics. Particles may comprise active agents, surfactants, wall forming materials, or other components considered desirable by those of ordinary skill.

The excipient may be included with the medicament via well-known methods, such as by admixing, co-precipitating and the like. Blends of excipients and drugs are typically formulated to allow the precise metering and dispersion of the blend into doses. A standard blend, for example, contains 13000 micrograms lactose mixed with 50 micrograms drug, yielding an excipient to drug ratio of 260:1. Dosage blends with excipient to drug ratios of from 100:1 to 1:1 may be used. At very low ratios of excipient to drug, however, the drug dose reproducibility may become more variable.

It will be understood that the present disclosure is for the purpose of illustration only and the invention extends to modifications, variations and improvements thereto.

The application of which this description and claims form part may be used as a basis for priority in respect of any subsequent application. The claims of such subsequent application may be directed to any feature or combination of features described therein. They may take the form of product, method or use claims or may include, by way of example and without limitation, one or more of the following claims:

The invention claimed is:

1. A method of loading a blister on an elongate blister strip with a defined quantity of powder which comprises the steps of:

providing a perforated plate in the form of a planar disk having plural perforations arranged in a circular path on the disk, each perforation extending form a first opening in a first side of the disk to a second opening on a second side of the disk; and a director member spaced from the first side of the disk;

the method also comprising the step of:

a) having relative rotary motion of the perforated plate and said director member with powder being disposed on the first side of he perforated plate on a first path thereon which is different from the circular path, said relative rotary motion comprising rotary movement of the perforated plate;

and the method further comprising the following steps while there is said relative rotary motion;

b) closing off one of the perforations in the disk by inserting a blanking pin into the perforation through the second opening;

c) directing powder from the first path onto the circular path;

d) directing powder on the circular path into said closed-off perforation by the sweeping action of the director member;

e) compacting said powder in the closed-off perforation by inserting a compacting pin into the closed-off perforation through the first opening; and f) transferring the compacted powder contents of the perforation to said blister through the second opening by withdrawing the blanking pin from the perforation through the second opening to reopen the perforation, placing the blister in registration with the second opening and moving the compacting pin towards the second opening to transfer the compacted powder contents into the blister, and wherein the elongate blister strip is moving continuously on a linear path as the blister is registered with the perforation and the compacted powder contents transferred thereinto.

2. A method according to claim 1, wherein the relative rotary motion is effected by the director member being held static and the perforated plate moving in rotary fashion relative thereto.

3. A method according to claim 1, wherein the director member presents a forward acute angle to the path of relative motion.

4. A method according to claim 3, wherein said forward acute angle is between 1 and 60°.

5. A method according to claim 4, wherein the forward acute angle is between 5 and 25°.

6. A method according to claim 3, wherein the director member presents multiple forward acute angles to the path of relative motion.

7. A method according to claim 6, wherein the director member is curved in form.

8. A method according to claim 6, wherein the director member is articulated in form.

9. A method according to claim 8, wherein the director member has a flat tail section.

10. A method according to claim 1, wherein a thin layer of powder is left on the first side of the perforated plate after movement of the director member.

11. A method according to claim 10, wherein the depth of said thin layer of powder is from 3 to 20 mm.

12. A method according to claim 11, wherein the depth of said thin layer of powder is from 4 to 8 mm.

13. A method according to claim 1, wherein the director member is a first director member and the powder is further directed into the perforation by at least one subsequent director member.

14. A method according to claim 13, wherein the at least one subsequent director member moves along the first side of the perforated plate at a lower level than that of the first director member.

15. A method according to claim 14, wherein the distance between the level of movement of the first director member and the at least one subsequent director member is 0 to 12 mm.

16. A method according to claim 15, wherein the distance between the level of movement of the first director member and the at least one subsequent director member is 1 to 3 mm.

17. A method according to claim 1, additionally comprising the step of removing excess powder from said circular path and directing the excess powder back to the first path subsequent to step d).

18. A method according to claim 17, comprising removing said excess powder by the action of a wiper.

19. The method according to claim 1, comprising the further following steps subsequent to step f):

i) withdrawing the compacting pin from the perforation through the first opening, and ii) repeating steps b)-f) at least once more to load another blister on the elongate blister strip with a defined quantity of powder.

20. A method according to claim 1, wherein directing powder into the closed-off perforation and transfer into the blister is a continuous step.

21. A method according to claim 1, wherein the powder is compacted to a volume of between 50 and 100% of the original volume of powder in the closed-off perforation.

22. A method according to claim 21, wherein the powder is compacted to a volume of between 70 and 90% of the original volume of powder in the closed-off perforation.

23. A method according to claim 1, additionally comprising applying a lid to the blister to protect the contents therein.

24. A method according to claim 1 for loading each of plural blisters arranged in series on the elongate blister strip with a defined quantity of powder as the strip moves continuously on the linear path, wherein the perforations are arranged in series on the circular path and each perforation is associated with its own blanking pin and compacting pin and wherein the method comprises:

closing off each perforation with its associated blanking pin in step b);

directing powder into each closed-off perforation in step d) by the sweeping action of the director member;

compacting said powder in each closed-off perforation in step e) by inserting the associated compacting pin into the closed-off perforation through the first opening; and transferring the compacted powder contents from the second opening of each perforation to a corresponding blister of said elongate blister strip in step f) by withdrawing the associated blanking pin from each perforation through the second opening and moving the associated compacting pin towards the second opening.

25. A method according to claim 24, wherein in step f) each perforation of the perforated plate is serially brought into registration with the corresponding blister of the blister strip and the compacted powder contents is transferred to the corresponding blister of the blister strip as the perforated plate is rotating and as the blister strip moves continuously on the linear path.

26. A method according to claim 1, wherein the powder comprises a medicament.

27. A method according to claim 26, wherein the medicament is selected from the group consisting of albuterol, salmeterol, fluticasone propionate and beclomethasone dipropionate and salts or solvates thereof and any mixtures thereof.

28. A method according to claim 1, wherein step c) is carried out by the action of a wiper.

29. A method according to claim 24, wherein each of steps b), d), e) and f) are performed serially on the perforations.

30. A method of loading each of plural blisters arranged in series on an elongate blister strip with a defined quantity of powder, which comprises providing a perforated plate in the form of a planar disk having plural perforations arranged in series on a circular path on the disk, each perforation extending from a first opening in a first side of the disk to a second opening in a second side of the disk;

a plurality of blanking pins and compacting pins, arranged such that and each perforation of said perforated plate is associated with its own blanking pin and compacting pin; and a director member spaced from the first side of the disk;

wherein the method also comprising the steps of:

a) having relative rotary motion of the perforated plate and said director member with powder being disposed on the first side of the perforated plate on a first path thereon which is different from the circular path, said relative rotary motion comprising rotary movement of the perforated plate; and the method further comprising the following steps while there is said relative rotary motion:

b) closing off each of the perforations in the disk by inserting an associated blanking pin into the perforation through the second opening;

c) directing powder from the first path onto the circular path;

d) directing powder on the circular path into each said closed-off perforation by the sweeping action of the director member;

e) compacting said powder in each closed-off perforation by inserting an associated compacting pin into the closed-off perforation through the first opening;

f) transferring the compacted powder contents of the perforations from the second opening of each perforation to a corresponding blister of said elongate blister strip by i) withdrawing the associated blanking pin from each perforation through the second opening to reopen the perforation, ii) placing the blister in registration with the second opening, and iii) moving the compacting pin towards the second opening to transfer the compacted powder contents into the blister; and g) withdrawing the compacting pin from the perforation through the first opening;

wherein the elongate blister strip is moving continuously on a linear path as the blisters are registered with the corresponding perforations and the compacted powder contents is transferred thereinto, and wherein each of steps b), d), e) and f) and g) are performed serially on the perforations.

31. A method according to claim 1 in which:

the blister is a first blister and the elongate blister strip has a second blister arranged side-by-side with the first blister on the elongate blister strip, the perforation is of a first set of perforations and the plate has a second set of perforations arranged concentrically with the first set in the circular path, when the first blister registers with the perforation of the first set the second blister registers with a perforation of the second set, and the perforation of the second set is associated with a blanking pin and a compacting pin to perform steps b) to f) thereon such that the first and second blisters are loaded at the same time.

32. A method according to claim 25 in which:

the plural blisters are a first series of blisters and the elongate blister strip has a second series of blisters arranged side-by-side with the first series on the elongate blister strip, the perforations are a first set of perforations and the plate has a second set of perforations arranged concentrically with the first set in the circular path, the blisters of the first and second series serially register with a corresponding perforation of the first and second set, and the perforations of the second set are each associated with a blanking pin and a compacting pin to perform steps b) to f) thereon such that the blisters of the first and second series are loaded serially at the same time.

* * * * *